United States Patent [19]

Prins

[11] Patent Number: 4,687,106

[45] Date of Patent: Aug. 18, 1987

[54] LETTER-MAIL CHECKING DEVICE

[75] Inventor: Geert J. Prins, Delft, Netherlands

[73] Assignee: Staat der Nederlanden (Staatsbedrijf der Posterijen, Telegrafie en Telefonie), The Hague, Netherlands

[21] Appl. No.: 869,442

[22] Filed: Apr. 27, 1986

Related U.S. Application Data

[63] Continuation of Ser. No. 619,055, Jun. 11, 1984, abandoned.

[30] Foreign Application Priority Data

Jun. 13, 1983 [NL] Netherlands ..... 8302102

[51] Int. Cl.[4] ..... B07C 1/16

[52] U.S. Cl. ..... 209/552; 73/159; 73/849; 209/603; 209/900; 271/262

[58] Field of Search ..... 209/548, 599, 600–604, 209/699, 900, 552; 271/262, 263; 73/159, 849, 862.45; 33/147 L

[56] References Cited

U.S. PATENT DOCUMENTS

| | | | |
|---|---|---|---|
| 4,030,607 | 6/1977 | Suda et al. | 209/600 |
| 4,121,716 | 10/1978 | Luperti et al. | 209/564 |
| 4,378,109 | 3/1983 | Takahashi et al. | 209/603 |

FOREIGN PATENT DOCUMENTS

| | | | |
|---|---|---|---|
| 1060168 | 6/1959 | Fed. Rep. of Germany . | |
| 1294723 | 5/1969 | Fed. Rep. of Germany | 209/599 |
| 1648751 | 4/1971 | Fed. Rep. of Germany . | |
| 1574164 | 11/1971 | Fed. Rep. of Germany . | |
| 287451 | 2/1965 | Netherlands . | |
| 854543 | 11/1960 | United Kingdom . | |

*Primary Examiner*—Randolph A. Reese
*Assistant Examiner*—Donald T. Hajec
*Attorney, Agent, or Firm*—Frishauf, Holtz, Goodman & Woodward

[57] ABSTRACT

A device for detecting postal articles unsuited for mechanical handling is equipped with a bed of belts formed by a large number of side-by-side resilient belts (2) assembled with predetermined tension around two pulleys (3,4), which can turn freely around shafts fixedly mounted on a base plate. A conveyor belt passes over a guiding roller (6) opposite the bed of belts. The conveyor direction of motion is deflected around the roller and the bed of belts is taken along by the conveyor belt (1) by means of friction. An article on the conveyor approaching the guiding roller while moving between the conveyor and the bed of belts is subjected to a bending force when passing the guiding roller. The belts of the bed of belts here work as scanning elements. Deflection of one or more of them from the normal path, away from the guiding roller (6), can be detected by a combination (11) of an infrared radiator and a detector. The position of this single radiator/detector combination (11) can be adjusted (17) in such a way that postal articles which are too thick, too rigid or too heavy, can be selected for diversion by a deflection of belt (2) detected by the radiator/detector combination (11).

4 Claims, 2 Drawing Figures

LETTER-MAIL CHECKING DEVICE

This application is a continuation of application Ser. No. 619,055, filed June 11, 1984 now abandoned.

FIELD AND BACKGROUND OF THE INVENTION

The invention relates to a device for checking letter-mail.

A known checking device developed for said purpose by Tokyo Shibaura Electric Co. Ltd. in Japan is adapted to check if the letters which are supplied to said checking device via a conveyor contain a hard object. For this purpose the latter checking device is provided with four cylindrical rollers, which are coaxially arranged in line and level, and which are each tiltably supported independently of one another. The axes of rotation of these rollers extend in a cross direction along a pair of conveyor belts of a letter-mail conveying device, which conveyor belts run parallel and are located in the same plane. A supporting roller is arranged adjacent to the sides of said conveyor belts which do not face the rollers, in such a way that said supporting roller will be in a position opposite to the aforesaid four rollers. By means of a special spring mechanism each of these rollers, which act as scanners, is pressed against the conveyor belts, which in their turn are pressed against said supporting roller. Each of said scanning rollers is coupled to a shutter adapted to interrupt a bundle of rays directed to a photosensitive detector, when the appurtenant scanning roller of the convevyor belt is tilted away. In the case when a letter on the conveyor belts has a thickened and hardened part, in such a way that relevant scanning roller is tilted away from the conveyor belts against the spring force exerted on such roller, and said bundle of rays is interrupted by the shutter, the detector will produce a signal to indicate that a letter does not meet the requirements. A device of this kind has the drawback that it can only be investigated if a letter supplied to this device contains a hard object which causes a local thickening to such an extent that it is unacceptable for a further letter-mail handling. Because of such a limited checking possibility this known technique cannot be used as an input check for automatic letter-mail handling machines in which letters have to pass switches which have been constructed especially for high speeds. The constructive embodiment of such machines imposes certain restrictions with regard to thickness, stiffness and weight on the letters that have to be handled. The machine handling can be disturbed e.g. if a letter contains an object of such a length and stiffness, e.g. a ballpoint pen, that it cannot pass through a bend occurring in the handling path of the machine. Disturbances in the working or damages to the machine can further be caused if the contents of a letter meet the requirements with regard to stiffness and thickness, but the weight of which is larger than a fixed upper limit value. Such disturbances involve that the machine has to be stopped, which with the high handling speeds leads to unacceptable disturbance frequencies already when the "contents-to-be-rejected" percentages are apparently small. When the contents of e.g. 1 out of every 1000 letters have to be rejected, this results in 30 disturbances (machine stops) on an average by the hour, which is unacceptable in connection with the requirements for the quality of service and for cost control.

A further drawback of the aforesaid known device is that the constructive embodiment is relatively complicated and vulnerable. Moreover, the setting of the separate spring mechanisms and stop pins is timeabsorbing and needlessly complicated.

SUMMARY OF THE INVENTION

The object of the invention is to meet the above-mentioned drawbacks. For that purpose the checking device according to the invention is characterized in that a number of belts, running parallel and next to one another side by side in the same plane and forming a bed of belts, function as a set of letter scanners; in that a guiding roller is placed in such a position with respect to said bed of belts and said conveyor belt that where said conveyor belt passes in contact with said guiding roller a short part of the bed of belts, of a lengthwise dimension corresponding to an opposite circumferential portion of the guiding roller, is flexibly held in engagement with the conveyor and a part of said conveyor belt which leaves from said guiding roller and a part of the bed of belts which is opposite to said part of the conveyor belt make substantially the same predetermined angle with the direction along which the conveyor belt arrives at said guiding roller, but may diverge enough from each other so that the bed of belts gradually becomes disengaged from the conveyor belt after passing the location of the guiding roller; in that the part of the bed of belts extending immediately before the location of the guiding roller remains spaced and clear from the conveyor. in that the part of the bed of belts before the guiding roller forms a first portion and the part extending beyond the guiding roller forms a second portion; and in that said detector is adapted in such a way that its detection area extends parallel to and transversely to the direction of movement of that part of the bed of belts that is opposite to that part of the conveyor belt that leaves from said guiding roller, and is positioned at a predetermined distance from the point where the bed of belts and the conveyor belt are deflected from their direction of arrival at that point by the guiding roller. The detector detects the displacement of at least one belt of the bed of belts from a normal attitude which the bed belts has while acceptable letters are between it and the conveyor, to an attitude of displacement of the at least one belt caused by a letter which exceeds a predetermined processing acceptability criterion. By making the distance between the detection area, more in particular a bundle of rays directed to a photosensitive detector, and the opposite part of the bed of belts guided by the guiding roller adjustable, the critical length at which a letter has to be rejected as being "too rigid" can be adjusted as desired.

Preferably the belts are made of a resilient synthetic material (polyurethane), such as e.g. polycord belts, each of such belts being assembled with a predetermined tension, of e.g. 5%. By using several belts lying next to one another in the same plane, relatively thin tubular objects with an unacceptable "rigidity length" can be detected irrespective of their position in the letter. Such belts offer the further advantage that a relatively high detection sensitiveness attendant on a strong attenuation will be obtained. In other words this means a quick response and a short time of vibration, which with the occurring high processing speeds involves a reliable detection working.

A checking device according to the invention can be used with advantage to check letters, before being supplied into an automatic handling machine, with regard to thickness, "rigidity length" and weight without interrupting the continuity of the flow of letters. Moreover, a reverse station normally occurring in such a machine can be used effectively as a means to route away the relevant letter from the input of the machine in response to a rejection signal produced by the detector, so that such a letter cannot cause a breakdown in the machine and is ejected without interrupting the continuity of the flow of letters.

A checking device according to the invention is particulary well useful when so-called batch mail has to be handled automatically.

BRIEF DESCRIPTION OF THE DRAWING

For a further elucidation of the invention an embodiment of the same will be described in what follows with reference to the drawing in which.

DESCRIPTION OF THE ILLUSTRATED EMBODIMENT

Figure 1:
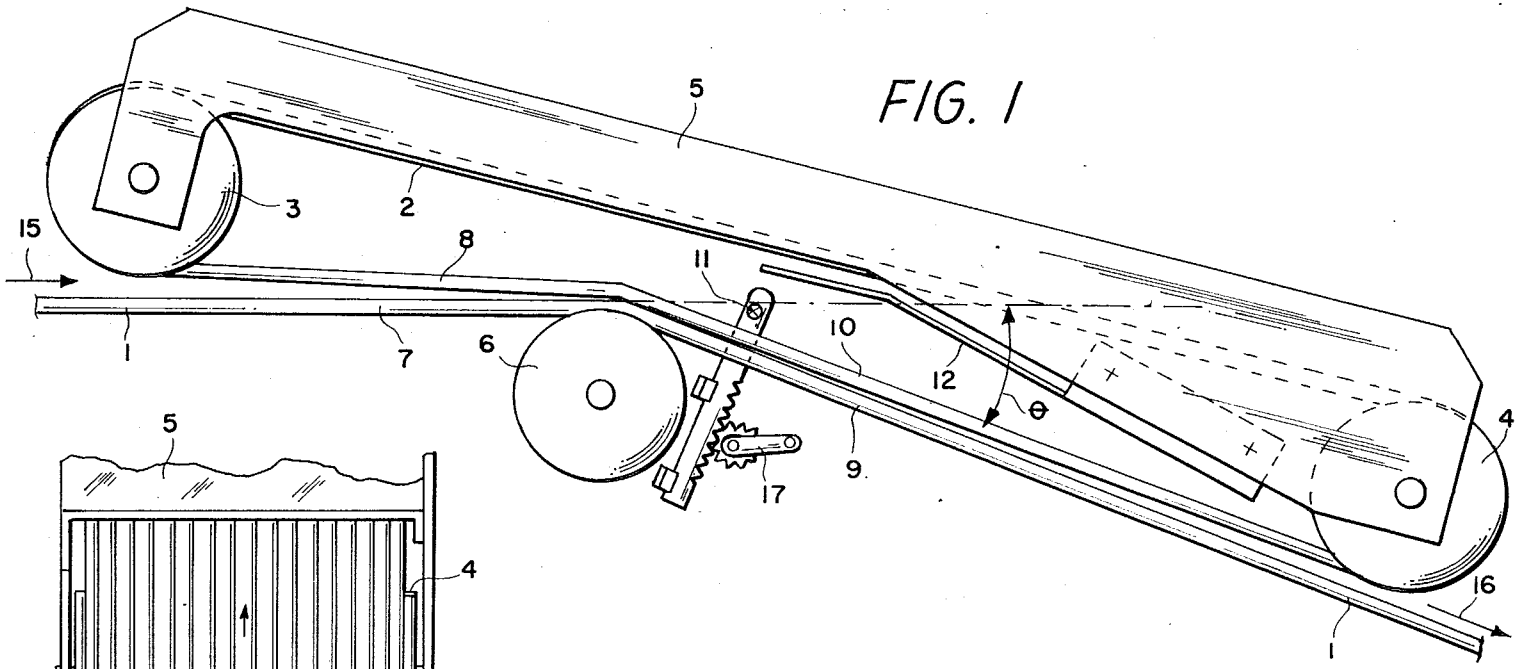
FIG. 1 is a diagrammatic side view representation of an embodiment of a checking device according to the invention in a cooperative connection with a letter-mail conveyor belt and FIG. 2 is a partial end view of the embodiment of FIG. 1 as seen from the right hand side of FIG. 1.
Figure 2:
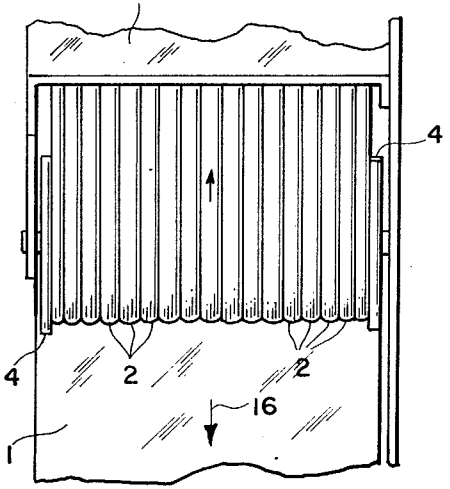

In the FIG. 1 designates a conveyor belt which is movable in the direction indicated by the arrow 15 and belongs to a letter transporting device, which is not drawn. As a rule a single belt with a width of e.g. 40 mm is made use of. Owing to an earlier handling it is ensured that the distances between the letters on this belt are mainly equal. An endless belt of a set of belts, running mainly parallel and next to one another and forming a so-called bed of belts, is designated by 2. The width of the bed of belts is preferably equal to the largest width to be expected of the flow of letters supplied via the conveyor belt. In a preferred embodiment this bed of belts comprises seventeen belts, as shown in FIG. 2, which are guided with a pitch of 10 mm by a first pulley 3 and a second pulley 4. These pulleys are provided in their cylindrical plane with belt guiding grooves, the cross-section shape of which is adapted to that of the belts. Preferably belts with a mainly circular cross section and with a diameter of abt. 4 mm are used. Belts suited for the purpose are e.g. the so-called polycord belts which are made of a resilient synthetic material (polyurethane). The belts are assembled round the pulleys with a certain tension e.g. 5%. Each of these pulleys 3 and 4 can turn on an appurtenant shaft, which is fixedly mounted on a base plate (running parallel to the plane of the drawing, but not shown) of the machine in which the checking device according to the invention is utilized. The two ends of said shafts which are not facing the base plate are coupled together by means of a frame plate 5. Thus the two pulleys 3 and 4 are rotatably mounted in a framework, which is formed by the frame plate, the two shafts and the base plate. With a construction of this kind it is possible to assemble the belts one by one round the two pulleys or to take them away from these pulleys in a simple way. In a similar way a guiding roller designated by 6 is rotatably mounted in a separate framework. This framework is formed by said base plate, a supporting element (not shown) fixedly mounted on and at right angles to that base plate, a supporting plate (not shown) mounted at the free end of said supporting element and running parallel to the base plate, and a shaft (not shown), rotatably supporting the guiding roller 6 and fixedly mounted between said supporting plate and the base plate. Preferably the width of said guiding roller is somewhat larger than the width of the bed at belts, in order to prevent the outermost belts of the bed of belts from being driven out of their relevant grooves when the letters are conveyed. The guiding roller 6 is provided with a recess having the shape of the cylindrical surface of that roller, in which recess the conveyor belt 1 guided along this roller 6 is countersunk in such a way that on the spot where this guiding roller is located the supporting surface of the letters of this conveyor belt is bent according to a radius of curvature which is mainly equal to that of the adjacent cylindrical surface of the guiding roller. In the embodiment of the present invention as described this guiding roller 6 and the conveyor belt 1 guided by the roller are located with regard to the bed of belts in such a way that the part 7 of the conveyor belt 1 arriving at this roller in a first direction designated by the arrow 15 forms, together with the opposite part 8 of the bed of belts a wedgeshaped space where the bed of belts is spaced from the conveyor belt and where a letter on the conveyor belt is taken along. This ensures that the letters supplied via the conveyor belt 1 are generally smoothly and without shocks further taken along between the bed of belts and the conveyor belt. As shown in FIG. 1, at the guiding roller 6 the bed of belts is flexibly engaged wtih the conveyor belt, even if no letters happen to be in-between, for imparting movement to the bed of belts in the same direction as the movement of the conveyor. According to an aspect of the invention the guiding roller 6 together with the conveyor belt guided by that roller are arranged adjacent to the bed of belts in such a way that the part 9 of this conveyor belt leaves from said guiding roller in a second direction designated by the arrow 16. The opposite part 10 of the bed of belts makes a predetermined angle with the first direction along which said part 7 of the conveyor belt arrives at the guiding roller. In this case an angle of abt. 25° is preferably chosen. In the construction as described above the conveyor belt which is moving on takes along the bed of belts by means of friction; in other words it is not necessary to couple one of the pulleys 3 and 4 to a separate drive mechanism. A letter which is moving on between the parts 7 and 8 will be subjected to a bending force on the spot where the guiding roller 6 is located. In this case the belts of the bed of belts are in fact working as scanning elements, of which the deflection from the normal path which is followed after the guiding roller 6 has been passed, is a measure for the thickness, rigidity or weight of the relevant letter. Should such a letter contain an object due to which this letter is too thick and/or too rigid and/or too heavy for further handling, one or more of the belts 2 (dependent on the shape and/or weight and/or position of the object in the letter), notably the part immediately after the guiding roller 6, will be deflected with an angle which is smaller than the predetermined angle of abt. 25° mentioned in the foregoing. This means that the part 10 of the relevant belt or belts will be located at a certain distance from the opposite part 9 of the conveyor belt.

According to a further aspect of the present invention it is detected when a distance as mentioned above has reached a critical value indicating that the relevant letter is not acceptable for further handling. For that purpose a radiation-sensitive detector is adapted in such a way that the detection area, that is a relatively thin bundle of rays, extends parallel to, respectively transversely to the direction of movement of the part 10 of the bed of belts which is opposite to the part 9 of the conveyor belt which leaves from the guiding roller 6, and is positioned at a distance, determined through experience, from the spot where the bed of belts and the conveyor belt are deflected from their direction of arrival at that point by the guiding roller 6. A source for transmitting a relatively thin bundle of infra-red rays directed to a receiving cell 11 sensitive to such rays is preferably used. This radiation source together with the appurtenant receiving cell form a constructive unit, which is adjustably mounted with regard to the framework for the guiding roller 6 as shown at 17 in FIG. 1. The rays are directed parallel to and transversely to the return part 10 of the bed of belts, thus defining a detection region extending parallel to and transversely to the part 10 of the bed of belts. In consequence of this the distance between the bundle of rays determining pencil-beam shaped region detection region, and the part 10 of the bed of belts, when being in its quiescent attitude as shown in FIG. 1, can be varied as desired and likewise the spacing between the detection region and the part 9 of the conveyor moving in the direction of the arrow 16. This distance has been chosen on the basis of a rigidity length, thickness and weight to be rejected of a letter to be checked. It has appeared that with such a single possibility of adjustment, combined with a chosen appropriate fixed distance between said bundle of rays and the tangent between the bed of belts and the guiding roller, letters which are supplied can be checked with regard to the said three criteria by means of only one single detection bundle. It can be achieved e.g. that a letter with a thickness of $>6$ mm, and/or a rigidity length of $>70$ mm will be rejected. It is further illustrative for the exactness of detection that e.g. a letter containing a steel plate with a thickness of 1 mm and a length of 70 mm will be rejected, whereas a letter containing a plate of the same size, but made of aluminium will not be rejected. This is due to the fact that the weight and, consequently, the kinetic energy of the steel plate is larger than that of the aluminum plate. In a situation in which the letters are rejected one or more belts of the bed of belts are deflected in such a way that the detection bundle will be interrupted when a letter passes along the guiding roller 6. In consequence of such an interruption a command signal, which can be used for initiating a switching action, resulting in the ejection of the relevant letter, will be produced at the output of the receiving cell. For this purpose a so-called reverse station, which is normally utilized in an initial part of an automatic letter sorting machine, can be made use of in an efficient way. Such a reverse station comprises a reversing element due to which a letter supplied to this station is put in a position necessary for further handling, at least when the reversing element is in normal operation. This normal operation of the reversing element can be switched off by means of a control signal, in consequence of which this reversing element will remain in such a position that a letter arriving at said station will be removed from the normal path used for further handling. It will be clear that a certain delay has to be introduced between the arising of the command signal and the subsequent switching action caused by that signal. This delay is mainly determined by the speed, e.g. 3 m/s, at which the letters are conveyed, and the distance of the path between the detection bundle and the reversing element over which a relevant letter has to be conveyed to arrive at that element. Instead of a reverse station a known switching device with a two-position switch can also be utilized, one position for letting the letters go straight on and the other position to let them deflect. The command signal puts the switch in the straight-on position, after which the rejected letters will be removed from the conveying system.

The belts working as scanning elements or sensor elements appear to produce a high detection sensitiveness attendant on a strong attenuation (short vibration time). This ensures a high degree of detection reliability with the high speeds at which the letters are conveyed. Moreover, the belts appear to be highly insensitive to temperature variations over a large area.

The distance between the two pulleys 3 and 4 as well as the position of the guiding roller 6 with regard to these pulleys have been chosen in such a way that letters of all letter formats occurring can pass the checking device without disturbances. A protection plate 12 fixed to a frame plate 5 has been mounted over the path via which the letters are conveyed, i.e. the parts 9 and 10. This protection plate ensures an undisturbed passage through the checking device under all circumstances occurring.

I claim:

1. A checking device for detecting letters which expand a processing acceptability criterion from acceptable letters which do not exceed said criterion, said criterion taking account of thickness, rigidity, length, and weight; said device comprising:

a moving belt conveyor for conveying said letters, said conveyor having a first part moving in a first direction and a second part moving in a second direction;

means, including a guiding roller (6) having, at all times during motion of said conveyor, a circumferential portion in contact with said conveyor, for deflecting movement of said conveyor from said first direction to said second direction;

a bed of side-by-side endless elastic belts (2) mounted on and around, and extending between, first and second pulleys (3,4) respectively mounted on rotation on spaced-apart fixed shafts and located relative to the conveyor and guiding roller in such a manner that a short portion of said bed of belts opposite said guiding roller, which short bed portion has a longitudinal dimension corresponding to said circumferential portion of said guiding roller then in contact with said conveyor, is flexibly held in engagement with said conveyor on the side of the conveyor opposite the side which is in engagement with said guiding roller, for imparting movement to said bed of belts in the same direction as the movement of said conveyor, while a first adjacent portion of said bed of belts (2) extending immediately before the location of said guiding roller remains spaced and clear from said conveyor (1) and a second adjacent portion of said bed of belts (2) extends beyond the location of said guiding roller and becomes disengaged from said conveyor, said letters being conveyed between the conveyor and the bed of belts; and means for detecting the displacement of at least one belt of said belts beds of belts (2) from a normal attitude which said bed of belts has while acceptable letters are between it and said conveyor, to an attitude of displacement of said at least one belt caused by a letter which exceeds said processing acceptability criterion; said detecting means including means (11) for providing a pencil-beam shaped detection region extending parallel to and transverse to said second adjacent portion (10) of said bed of belts, said detection region being spaced at a predetermined distance from the location where said conveyor has its movement deflected by said deflecting means from said first direction into said second direction.

2. Checking device in accordance with claim 1, wherein each of the belts (2) of said bed of belts is impressed with a predetermined tension to produce said bed of belts as a tensioned elastic bed of belts.

3. Checking device in accordance with claim 1, wherein said detecting means are adjustably mounted in such a way that said minimum spacing thereof from said belt conveyor can be varied as desired.

4. Checking device in accordance with claim 3 wherein each of the belts of said bed is impressed with a predetermined tension to produce said bed of belts as a tensioned elastic bed of belts.

* * * * *